US008256363B2

(12) United States Patent
Tokura

(10) Patent No.: US 8,256,363 B2
(45) Date of Patent: Sep. 4, 2012

(54) SEWING MACHINE

(75) Inventor: Masashi Tokura, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 44 days.

(21) Appl. No.: 12/909,212

(22) Filed: Oct. 21, 2010

(65) Prior Publication Data

US 2011/0094424 A1 Apr. 28, 2011

(30) Foreign Application Priority Data

Oct. 22, 2009 (JP) ..... 2009-243425

(51) Int. Cl.
*D05B 21/00* (2006.01)

(52) U.S. Cl. ..... 112/102.5

(58) Field of Classification Search ..... 700/136, 700/137, 138; 112/102.5, 470.01, 445, 456, 112/458, 470.06, 470.04, 475.19
See application file for complete search history.

(56) References Cited

U.S. PATENT DOCUMENTS 4,849,902 A * 7/1989 Yokoe et al. ..... 112/470.04
5,343,401 A * 8/1994 Goldberg et al. ..... 700/138
5,390,126 A * 2/1995 Kongho et al. ..... 700/138
5,740,057 A * 4/1998 Futamura ..... 700/138
5,769,013 A * 6/1998 Morita ..... 112/102.5
6,321,671 B1 * 11/2001 Tomita ..... 112/475.19

FOREIGN PATENT DOCUMENTS

JP A-5-42279 2/1993

* cited by examiner

*Primary Examiner* — Tejash Patel

(74) *Attorney, Agent, or Firm* — Oliff & Berridge, PLC

(57) ABSTRACT

An embroiderable sewing machine including an embroidery frame holding a workpiece cloth; an embroidery frame transfer mechanism horizontally transferring the embroidery frame; a display device capable displaying an image of an embroidery pattern to be sewn; a zoom rate specifier that specifies a zoom rate for enlarging/shrinking the embroidery pattern image; an input section that receives inputs of instructions for moving a location of the embroidery pattern within an embroiderable area defined by the embroidery frame, the instructions including a movement direction and a movement amount; a movement amount modifier modifying the movement amount inputted by the input section for the embroidery pattern image based on the zoom rate specified by the zoom rate specifier; and a display controller that transfers the embroidery pattern image based on the movement amount modified by the movement amount modifier in response to the input from the input section.

4 Claims, 11 Drawing Sheets

SEWING MACHINE

CROSS-REFERENCE TO RELATED APPLICATIONS

This application is based upon and claims the benefit of priority from the prior Japanese Patent Application 2009-243425, filed on Oct. 22, 2009, the entire content of which are incorporated herein by reference.

FIELD

The present disclosure relates to an embroiderable sewing machine.

BACKGROUND

Sewing machines are known that are provided with a display for displaying images of embroidery patterns to be sewn. In such sewing machines, the embroidery pattern images displayed on the display can be edited by typically being enlarged or shrunk in size through user input such as a mouse operation. Based on the edited image of the embroidery pattern displayed on the display, the sewing machine sews the embroidery pattern on a workpiece cloth held by an embroidery frame. A typical embroiderable sewing machine of such type comes with a transfer key for transferring the embroidery frame and consequently the workpiece cloth held by it. The user is allowed to make adjustments in the location where the embroidery pattern is to be formed relative to the embroidery frame. The transfer key is also utilized for transferring the location of the embroidery pattern image being displayed on the display.

However, the amount of transfer or movement of the embroidery pattern image displayed on the display in response to the inputs made through the transfer key is in proportional correlation with the zoom rate of the displayed embroidery pattern image. Thus, the amount of movement of the embroidery pattern image in response to a single operation of the transfer key is relatively greater when the zoom rate of the embroidery pattern image displayed on the display is relatively greater. In such case, the amount of movement in the location of the embroidery pattern relative to the embroidery frame becomes relatively greater, rending subtle adjustments in the location of the embroidery pattern difficult. By contrast, the amount of movement of the embroidery pattern image in response to a single operation of the transfer key is relatively smaller when the zoom rate of the embroidery pattern image displayed on the display is relatively smaller. In such case, the amount of movement in the location of the embroidery pattern relative to the embroidery frame becomes relatively smaller in which case the transfer key needs to be operated multiple times in order to obtain the desired amount of movement in the location of the embroidery pattern.

SUMMARY

One object of the present disclosure is to provide a sewing machine that precisely yet readily determines the location of an embroidery pattern to be sewn by appropriately specifying/modifying the movement amount of an embroidery pattern image displayed on a display device in consideration of the zoom rate of the embroidery pattern image.

Another object of the present disclosure is to provide a sewing machine that precisely yet readily determines the location of an embroidery pattern to be sewn by appropriately specifying the movement amount of an embroidery frame in consideration of the zoom rate of the embroidery pattern image.

In one aspect of the present disclosure, an embroiderable sewing machine includes an embroidery frame that holds a workpiece cloth; an embroidery frame transfer mechanism that horizontally transfers the embroidery frame; a display device that is capable of displaying an image of an embroidery pattern to be sewn on the workpiece cloth as an embroidery pattern image; a zoom rate specifier that specifies a zoom rate for enlarging or shrinking the embroidery pattern image displayed on the display device; an input section that receives inputs of instructions for moving a location of the embroidery pattern to be sewn within an embroiderable area defined by the embroidery frame, the instructions including a movement direction and a movement amount; a movement amount modifier that modifies the movement amount inputted by the input section for the embroidery pattern image displayed on the display device based on the zoom rate specified by the zoom rate specifier; and a display controller that transfers the embroidery pattern image displayed on the display device based on the movement amount modified by the zoom rate specifier in response to the input from the input section.

According to the above described configuration, the movement amount modifier, when receiving the input from the input section, specifies the movement amount of the embroidery pattern image displayed on the display device in consideration of the zoom rate specified by the zoom rate specifier. The display controller effects the transfer of the embroidery pattern image displayed on the display device depending on the movement amount specified by the movement amount modifier. Thus, the embroidery pattern image being displayed on the display device relatively increases or decreases the movement amount effected by the input from the instruction input section in consideration of the zoom rate. The above described configuration precisely yet readily determines the location of the embroidery pattern to be sewn.

In another aspect of the present disclosure, the embroiderable sewing machine includes an embroidery frame that holds a workpiece cloth; an embroidery frame transfer mechanism that horizontally transfers the embroidery frame; an image capturing device that captures images of the workpiece cloth held by the embroidery frame so that the captured images show portions of the workpiece cloth where stitches are formed and peripheral portions thereof; a display device that is capable of displaying a display image generated based on the image captured by the image capturing device; a zoom rate specifier that specifies a zoom rate for enlarging or shrinking the embroidery pattern image displayed on the display device; an input section that receives inputs of instructions for moving a location of the embroidery frame, the instructions including a movement direction; a movement amount modifier that modifies the movement amount of the embroidery frame transferred by the embroidery frame transfer mechanism based on the zoom rate specified by the zoom rate specifier; and a controller that controls the embroidery frame transfer mechanism so that the embroidery frame is transferred based on the movement amount modified by the movement amount modifier in response to the input from the input section.

According to the above described configuration, the movement amount modifier, when receiving the input from the input section, specifies the movement amount of the embroidery frame transferred by the embroidery frame transfer mechanism depending on the zoom rate specified by the zoom rate specifier. The controller effects the transfer of the embroidery frame driven by the embroidery frame transfer mechanism depending on the movement amount specified by the movement amount modifier. Thus, the embroidery frame being transferred by the embroidery frame transfer mechanism relatively increases or decreases the movement amount effected by the input from the instruction input section in consideration of the zoom rate of the display image displayed on the display device. The above described configuration precisely yet readily determines the location of the embroidery pattern to be sewn.

BRIEF DESCRIPTION OF THE DRAWINGS

Other objects, features and advantages of the present disclosure will become clear upon reviewing the following description of the illustrative aspects with reference to the accompanying drawings, in which.

DETAILED DESCRIPTION

Exemplary embodiments of the present disclosure will be described through an example of a sewing machine with reference to the accompanying drawings. Elements that are similar or identical across the exemplary embodiments are identified with similar or identical reference symbols and will not be re-described.

Figure 1:
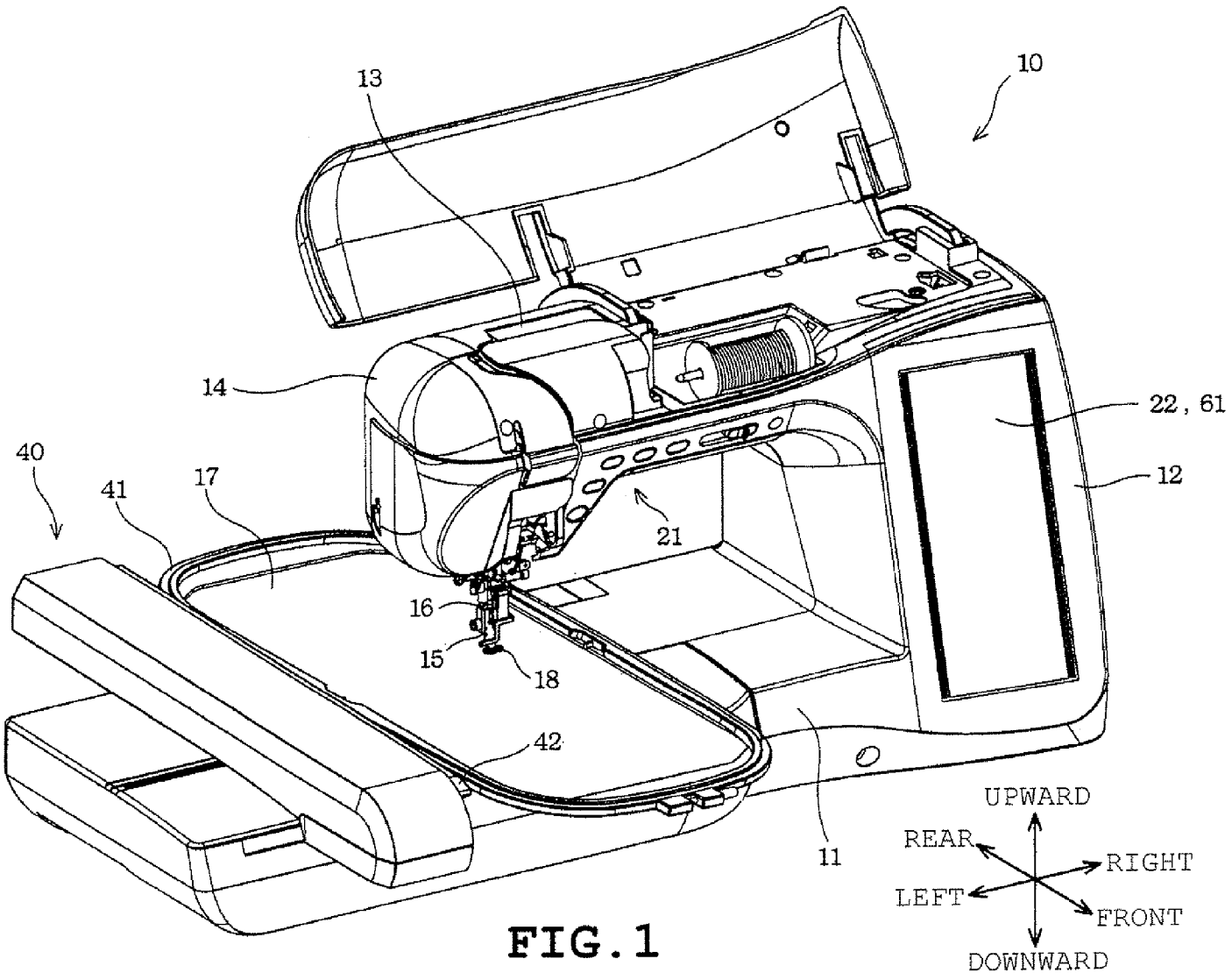
FIG. 1 is a general perspective view of a sewing machine according to a first exemplary embodiment of the present disclosure.

Sewing machine 10 according to a first exemplary embodiment of the present disclosure is shown in FIG. 1. Throughout the description, unless otherwise indicated herein, the direction in which the user positions himself/herself relative to sewing machine 10 is defined as the front side as indicated by the arrow in FIG. 1.

Sewing machine 10 is an integral assembly of bed 11, pillar 12, arm 13, and head 14. Bed 11 is located at the lower end of sewing machine 10 and pillar 12 stands up from the right end of bed 11. Arm 13 extends leftward over bed 11 from the upper end of pillar 12 so as to be substantially parallel to bed 11. Arm 13 terminates into head 14 at its left end. Within arm 13, a sewing machine main shaft not shown is provided that extends in the left and right direction. Further within arm 13, a sewing machine not shown is provided that drives the sewing machine main shaft in rotation.

Within head 14, needle bar 16 is provided that has sewing needle 15 attached to its lower end. In close proximity of sewing needle 15, presser foot 18 is provided for pressing down workpiece cloth 17 during the embroidery sewing operation. Arm 13 further contains components such as needle-bar drive mechanism, needle-bar swing mechanism, and thread take-up mechanism neither of which is shown. The needle-bar drive mechanism drives needle bar 16 up and down based on the rotation of the sewing machine main shaft. The needle bar swing mechanism swings needle bar 16 in the left and right direction orthogonal to the direction in which workpiece cloth 17 is fed. The thread take-up mechanism drives a thread take-up not shown up and down in synch with the up and down movement of needle bar 16.

On the top surface of Bed 11, a needle plate not shown is provided that confronts arm 13. Bed 11 contains components such as a feed mechanism, horizontal rotary hook, and thread cut mechanism neither of which is shown. The feed mechanism is disposed below the needle bar and drives the feed dog up and down and front and back. The horizontal rotary hook contains a bobbin not shown and forms stitches in co-operation with sewing needle 15. The thread cut mechanism cuts the needle and bobbin thread.

Arm 13 is provided with various control switches on its front face, whereas on the front face of pillar 12, a sizable color liquid crystal display 22 is provided, which is also referred to as LCD 22 hereinafter. LCD 22 displays images of various stitches such as embroidery stitches and utility stitches, names of functionalities to be executed during the sewing operation, and various information related to the sewing operation. The front face of LCD 22 is configured as a touch panel implemented by transparent touch keys comprising transparent electrodes. Selection of the embroidery pattern to be sewn, execution of functionalities, and specification of various sewing parameters such as feed amount and needle swing amount are made in response to user of operation of the touch keys.

Figure 2:
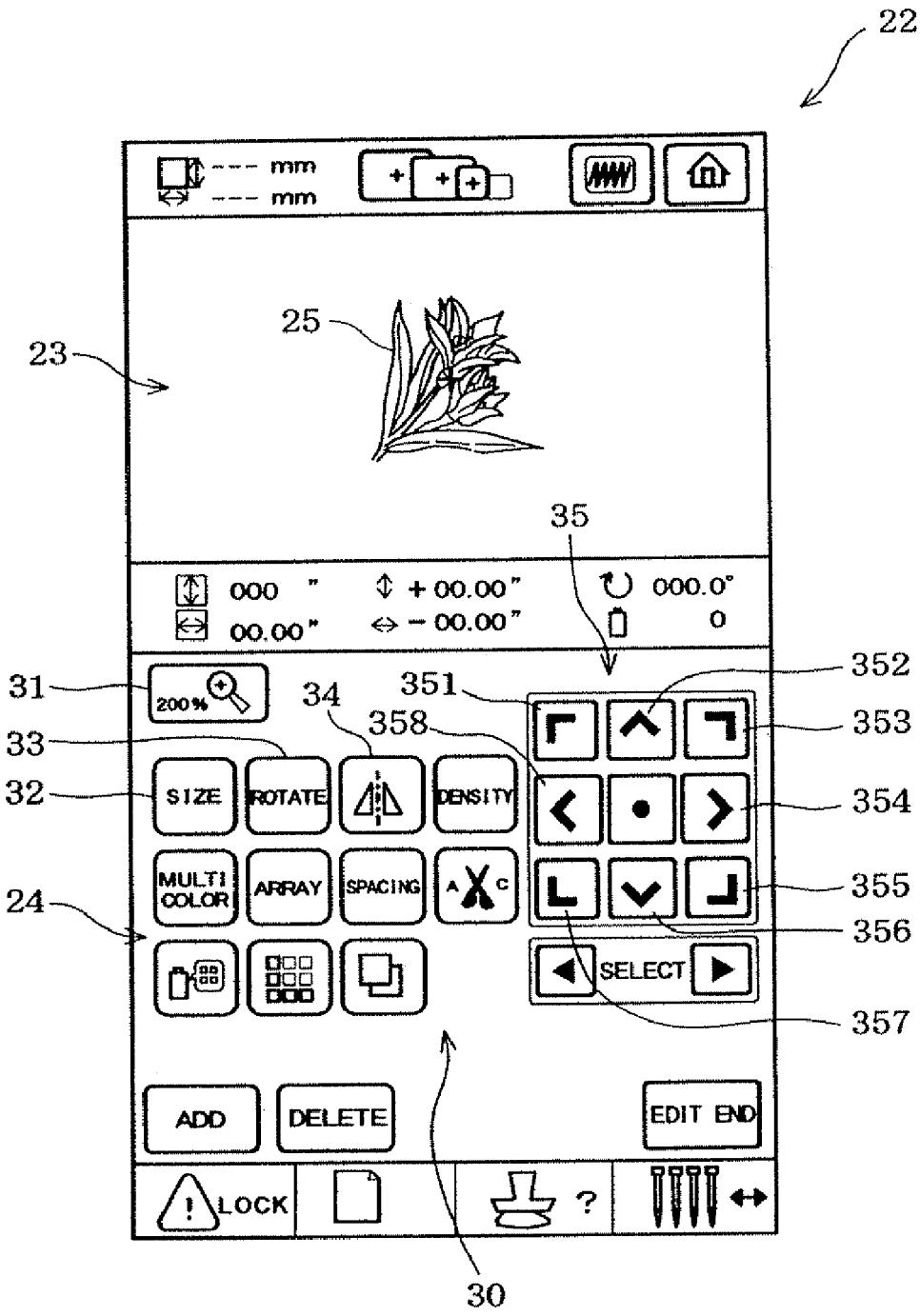
FIG. 2 illustrates an exemplary output of liquid crystal display showing an embroidery pattern image according to the first exemplary embodiment of the present disclosure.
Figure 3:
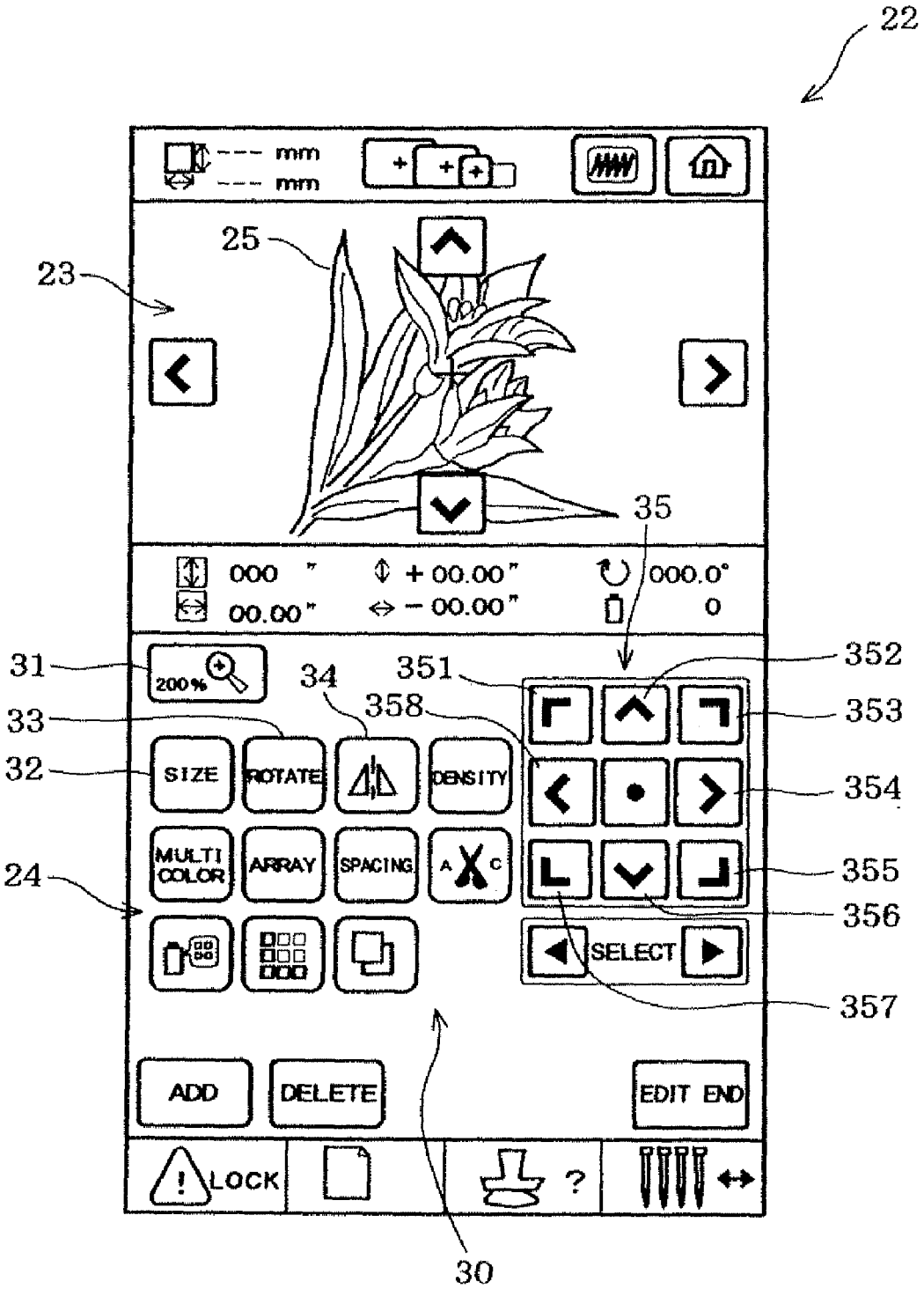
FIG. 3 illustrates an exemplary output of liquid crystal display showing an enlarged embroidery pattern image according to the first exemplary embodiment of the present disclosure.

LCD 22 is provided with image display area 23 and key display area 24 as exemplified in FIGS. 2 and 3. Image display area 23 displays images such as embroidery pattern image 25 corresponding to the embroidery pattern to be sewn. Key display area 24 displays input keys 30 operable by the user. Input keys 30 provide instructions for transferring or editing embroidery pattern image 25 displayed in image display region 23. Input keys 30 include zoom key 31, size key 32, rotate key 33, and inverse key 34. Zoom key 31 inputs instructions for enlarging or shrinking the size of embroidery pattern image 25 being displayed on image display area 23. Size key 32, on the other hand, specifies the actual size of the embroidery pattern to sewn on workpiece cloth 17 based on embroidery pattern image 25 displayed on image display area 23. More specifically, operation of zoom key 31 does not modify the size of the embroidery pattern to be sewn on workpiece cloth 17, but enlarges or shrinks the size of embroidery pattern image 25 displayed on image display area 23. By contrast, operation of size key 32 specifies the actual size of the embroidery pattern itself to be sewn on workpiece cloth 17. Rotate key 33 rotates embroidery pattern image 25 being displayed on image display area 23 and inverse key 34 inverses embroidery pattern image 25 displayed on image display area 23.

Input key 30 further includes transfer key 35 which comprises 8 direction keys 351 to 358 to instruct the direction in which embroidery pattern image 25 is to be transferred. Direction key 351 instructs transfer of embroidery pattern image 25 in the upper left direction on image display area 23. Likewise, direction key 352 instructs transfer of embroidery pattern image 25 in the upward direction, direction key 353 in the upper right direction, direction key 354 in the rightward direction, direction key 355 in the lower right direction, direction key 356 un the lower direction, direction key 357 in the lower left direction, and direction key 358 in the leftward direction.

Referring back to FIG. 1, embroidery frame transfer mechanism 40 is detachably attached to the left end of Bed 11. Embroidery frame transfer mechanism 40 transfers embroidery frame 41 in two predetermined directions over bed 11. Embroidery frame 41 holds workpiece cloth 17, on which stitches are formed. Embroidery frame transfer mechanism 40 is provided with carriage 42, X-direction transfer mechanism and Y-direction transfer mechanism neither of which is shown. Carriage 42 supports embroidery frame 41 which is detachably attached to it. The X-direction transfer mechanism and the Y-direction transfer mechanism transfer carriage 42 supporting embroidery frame 41 in the X and Y directions. Sewing machine 10 typically operates under the normal sewing mode and the embroidery sewing mode. The attachment of embroidery frame 40 to bed 11 causes mode switching from the normal sewing mode to the embroidery sewing mode. The X-direction transfer mechanism and the Y-direction transfer mechanism are driven independently based on the selected embroidery pattern to transfer embroidery frame 41 attached to carriage 32 in the X direction corresponding to the left and right direction and the Y direction corresponding to the front and rear direction.

Next, a description will be given on the electric configuration of sewing machine 10.

Figure 4:
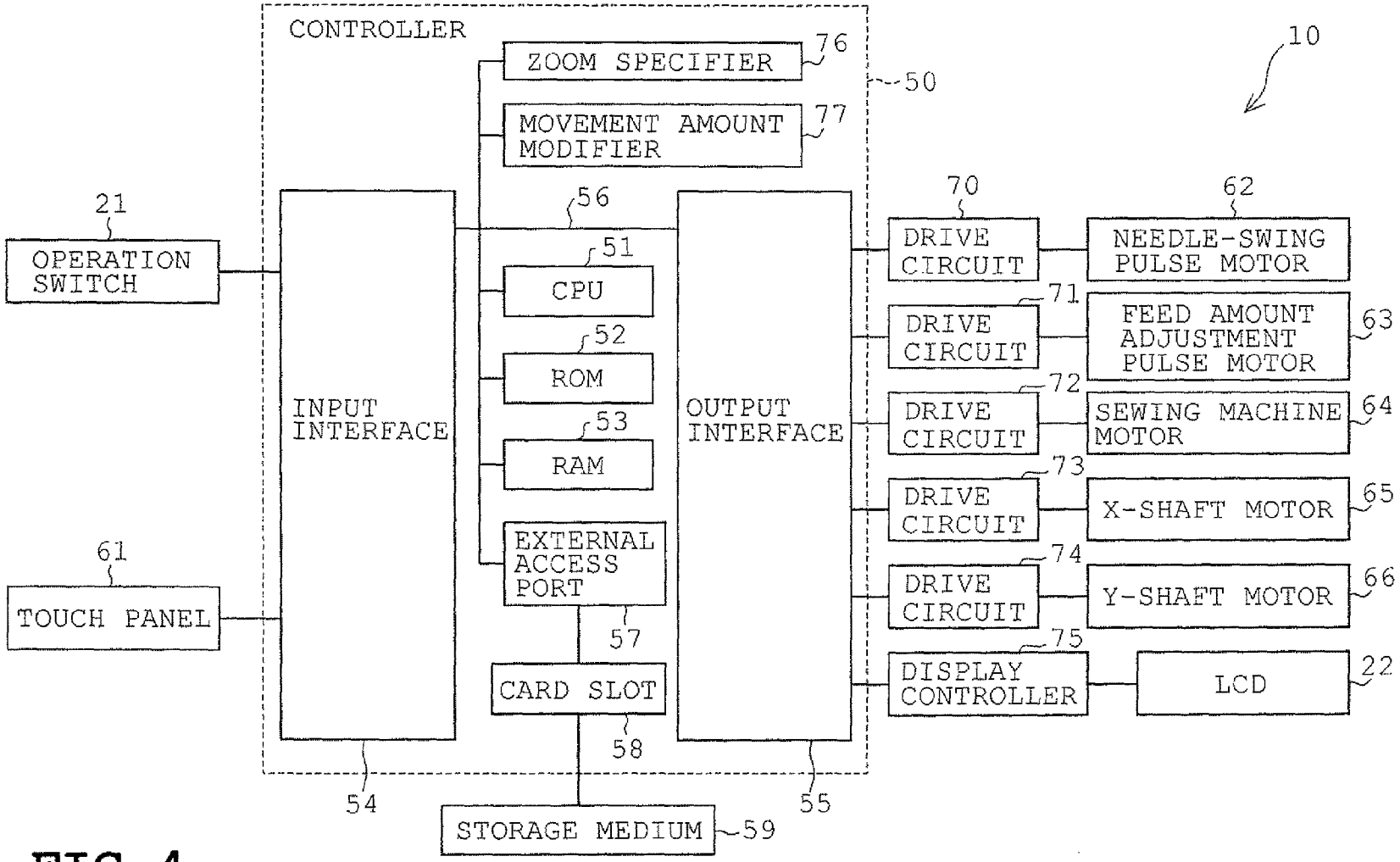
FIG. 4 is a block diagram indicating an electric configuration of the sewing machine according to the first exemplary embodiment of the present disclosure.

Referring to FIG. 4, sewing machine 10 is provided with controller 50. Controller 50 is primarily configured by a microcomputer including components such as CPU 51, ROM 52, RAM 53, input interface 54, output interface 55, and bus 56 interconnecting the foregoing components. Controller 50 is capable of accessing nonvolatile storage medium 59 such as memory cards though interfaces such as external access port 57 and card slot 58. Input interface 54 establishes connections with various operation switches 21 and touch panel 61 provided integrally with LCD 22. Operation switch 21 includes controls such as a sewing switch and a speed adjustment dial. The speed adjustment dial, when turned, makes adjustments in sewing speed. Touch panel 61 receives inputs made through input keys 30 comprising zoom key 31, size key 32, rotate key 33, inverse key 34, and transfer key 35.

Output interface 55 establish connections with needle sewing pulse motor 62, feed adjustment pulse motor 63, sewing machine motor 64, X-shaft motor 65 of the X-direction transfer mechanism, Y-shaft motor 66 of the Y-direction transfer mechanism, and LCD 22. Needle sewing pulse motor 62, feed adjustment pulse motor 63, sewing machine motor 64, X- and Y-shaft motors 65 and 66 are connected to output interface through drive circuits 70 to 74. LCD 22 is connected to output interface 55 by way of display controller 75.

Controller 50 includes zoom specifier 76 and movement amount modifier 77 in addition to display controller 75. Display controller 75, zoom specifier 76, and movement amount modifier 77 are implemented as software configuration in which computer programs such as a display control program, a zoom specifying program, and movement amount modifying program are executed by CPU 51. As one of ordinary skill in the art would readily appreciate, display controller 75, zoom specifier 76, and movement amount modifier 77 may also be implemented as a hardware configuration.

Figure 5:
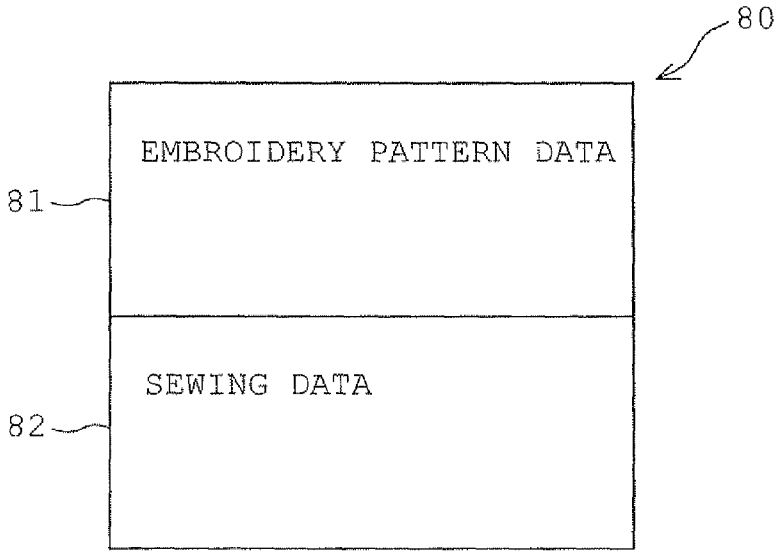
FIG. 5 schematically indicates data configuration of embroidery pattern data according to a first exemplary embodiment of the present disclosure.

Zoom specifier 76 specifies the zoom rate in which embroidery pattern image 25 displayed on LCD 22 is either enlarged or shrunk. More specifically, zoom specifier 76 specifies the zoom rate of embroidery pattern image 25 through enlarge or shrink instructions inputted through zoom key 31 shown in FIG. 2. Embroidery pattern image 25 is generated based on embroidery pattern data 80 as can be seen in FIG. 5.

Embroidery pattern data 80 is configured by pattern image data 81 and sew data 82 that are stored in medium such ROM 52 and external storage medium 59. Pattern image data 81 is image data such as bmp and gif constituting the basis of embroidery pattern image 25. Display controller 75 generates embroidery pattern image 25 from pattern image data 81 contained in embroidery pattern data 80 and outputs the generated embroidery pattern image 25 to LCD 22. Sew data 82, on the other hand, contains data for sewing embroidery pattern corresponding to embroidery pattern image 25 on workpiece cloth 17. For instance, sew data 82 contains various types of data such as needle drop coordinate data and thread color data that are required in automatically sewing the selected embroidery pattern. To elaborate, needle drop coordinate data is an equivalent of transfer data of embroidery frame 41, that indicates the location or the dot on which sewing needle 15 is pierced through workpiece cloth 17 for stitch formation. Thread color data indicates the color of needle thread to be used.

Controller 50 outputs embroidery pattern image 25 on LCD 22 based on pattern image data 81. Further, controller 50 drives sewing machine motor 64, X-shaft motor 65, and Y-shaft motor 66 based on sew data 82. Sewing machine motor 64 drives components such as needle bar 16, the thread take-up, and horizontal rotary shuttle through the aforementioned drive mechanisms. X-shaft motor 65 and Y-shaft motor 66 drive embroidery frame transfer mechanism 41 to transfer carriage 42 in the X and Y directions. The embroidery pattern corresponding to embroidery pattern image 25 displayed on LCD 22 is thus formed automatically on workpiece cloth 17 held by embroidery frame 41.

Movement amount modifier 77 specifies/modifies the movement amount of embroidery pattern image 25 displayed LCD 22 based on the zoom rate specified by zoom rate specifier 76 in response to the inputs given by transfer key 35. By contrast, supposing that the conventional configuration and control schemes were applied to sewing machine 10 of the present disclosure, the distance in which embroidery pattern image 25 travels on LCD 22 by a single input of transfer key 35 is in proportional correlation with the zoom rate. Thus, when embroidery pattern image 25 is enlarged, the movement amount of embroidery pattern image 25 effected by a single input operation of transfer key 35 is relatively greater. When embroidery pattern image 25 is shrunk, the movement amount of embroidery pattern image 25 effected by a single input operation of transfer key 35 is relatively smaller. Under such configuration, it is difficult to make subtle adjustments in the location of embroidery pattern image 25 when LCD 22 is displayed in enlarged zoom rate. When LCD 22 is displayed in shrunk zoom rate, transfer key 35 needs to be operated increased number of times to obtain a large movement amount.

By contrast, the present exemplary embodiment is configured such that, in response to the input made through transfer key 35, movement amount modifier 77 specifies/modifies the amount of movement of embroidery pattern image 25 displayed on LCD 22 at an appropriate amount in consideration of the zoom rate specified by zoom specifier 76. Thus, the amount of movement of embroidery pattern image 25 is specified/modified depending upon the zoom rate in which embroidery pattern image 25 is displayed on LCD 22. The above described arrangement facilitates elaborate location of embroidery pattern image 25 which may be displayed at both enlarged zoom rate and shrunk zoom rate on LCD 22. In response to the inputs made through transfer key 35, display controller 75 generates a simulated image of embroidery pattern image 25 in its relocated state, reflective of the modified movement amount of movement amount modifier 77, and displays the generated image on LCD 22.

Figure 6:
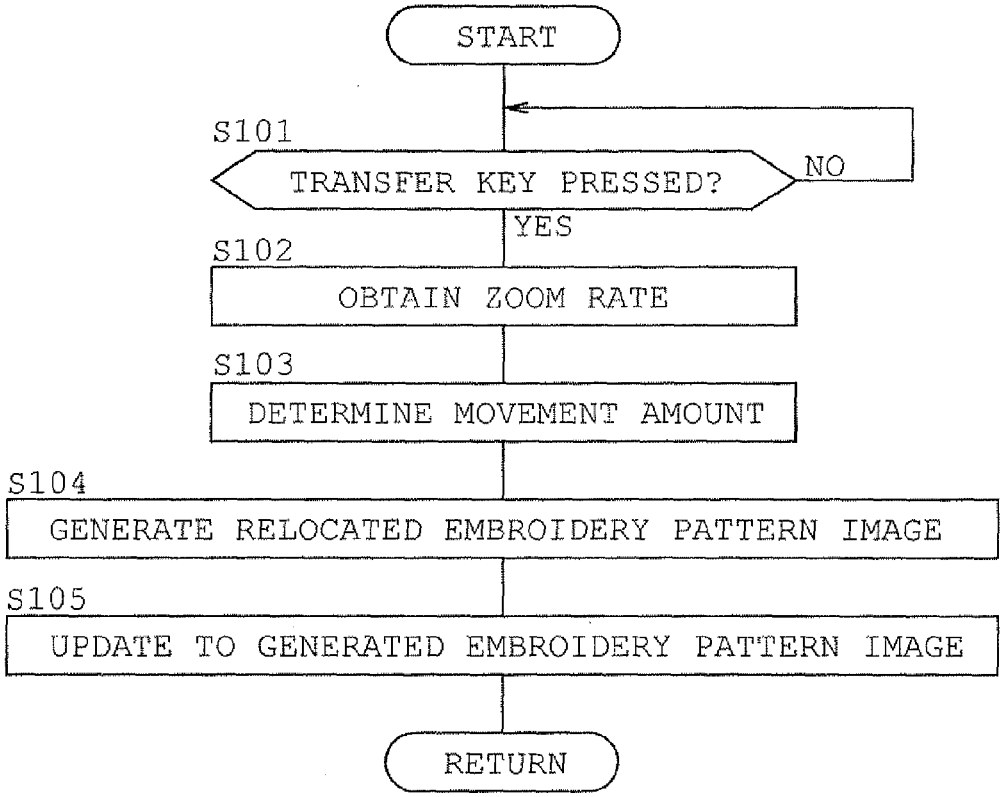
FIG. 6 is a flowchart indicating the process flow executed by the sewing machine according to the first exemplary embodiment of the present disclosure.

Next, the process flow of a transfer process of embroidery pattern image 25 displayed on LCD 22 will described in detail based on FIG. 6.

Controller 50 monitors the presence/absence of the depression of transfer key 35 (step: S101). In other words, controller 50 determines whether or not touch operation has been made on either of the direction keys 351 to 358 displayed as transfer keys 35 on LCD 22. Controller 50, when determining that transfer key 35 has not been depressed (S101: No), stands by until transfer key 35 is depressed.

When controller 50 determines that any one of direction keys 351 to 358 of transfer key 35 has been depressed (S101: Yes), retrieves zoom rate M of embroidery pattern image 25 currently being displayed on LCD 22 (S102) from zoom specifier 76. For instance, when embroidery pattern image 25 displayed on LCD 22 is in its initialized state, zoom rate M of embroidery pattern image 25 indicates M=100%. When embroidery pattern image 25 is enlarged through operation of zoom key 31, zoom rate M(%) of embroidery pattern image 25 indicates 100<M, whereas when it is shrunk through operation zoom key 31, zoom rate M(%) indicates M<100.

Controller 50, upon retrieving zoom rate M, proceeds to determine movement amount T based on the retrieved zoom rate M by way of movement amount modifier 77 (S103). To elaborate, movement amount modifier 77 determines movement amount T of embroidery pattern image 25 displayed on LCD 22, which is effected by a single depression of transfer key 35, based on zoom rate M of embroidery pattern image 25. More specifically, in one exemplary embodiment, movement amount modifier 77 controls movement amount T effected by a single depression of transfer key 35 such that movement amount, typically represented in number of dots, of embroidery pattern image 25 within image display area 23 of LCD 22 is constant irrespective of its zoom rate M.

For instance, when zoom rate M=100%, embroidery pattern image 25 displayed on LCD 22 is moved by 10 dots by a single depression of transfer key 35. Under the conventional configuration, movement amount T is determined proportional to zoom rate M, and thus, when zoom rate M=200%, the embroidery pattern image 25 displayed on LCD 22 is moved by 20 dots, whereas when zoom rate M=300%, embroidery pattern image 25 displayed on LCD 22 is moved by 30 dots is moved by 10 dots by a single depression of transfer key 35. By contrast, when zoom rate M=50%, embroidery pattern image 25 displayed on LCD 22 is moved by 5 dots by a single depression of transfer key 35. As can be seen through the above given examples, the amount of movement of embroidery pattern image 25 rendered by a single depression of transfer key 35 increases with zoom rate M to render subtle location adjustment difficult, whereas the amount of movement of embroidery pattern image 25 rendered by a single depression of transfer key 35 decreases with zoom rate M to require increased number of depressions of transfer key 35 to transfer embroidery frame 25 in the desired amount.

According to the first exemplary embodiment, movement amount modifier 77 determines the appropriate movement amount T based on zoom rate M such that the determined movement amount T of embroidery pattern image 25 displayed on LCD 22 appears to be not correlated with zoom rate M of embroidery pattern image 25 so that movement amount T of embroidery pattern image 25 on LCD 22 is constant. For instance, supposing that movement amount T effected by a single depression of transfer key 35 is 10 dots when zoom rate M=100%, the first exemplary embodiment is configured such that movement amount modifier 77 specifies movement amount T of embroidery pattern image 25 displayed on LCD 22 effected by a single depression of transfer key 35 to be 10 dots even if zoom rate M is varied to M=200% and M=300%. Thus, movement amount T of embroidery pattern image 25 displayed on LCD 22 stays constant at 10 dots regardless of variation in zoom rate M. According to such configuration, supposing that movement amount T of embroidery pattern image 25 at zoom rate M=100% is represented as X, movement amount T of embroidery pattern image 25 viewed at zoom rate M=200% can be represented as ½X. This means that, movement of 10 dots on LCD 22 when viewed at zoom rate M=200% corresponds to movement of 5 dots viewed at zoom rate M=100%. Similarly, when zoom rate M=300%, movement amount T of embroidery pattern image 25 can be represented as ⅓X. When, zoom rate M=50%, movement amount T of embroidery pattern image 25 on LCD 22 stays constant at 10 dots. Thus, movement amount T of embroidery pattern image 25 displayed at zoom rate M=50% appears to be 2× or twice of the amount of movement at zoom rate M=100.

As described above, movement amount modifier 77 is configured to specify/modify the movement amount T, typically represented by number or dots, of embroidery pattern image 25 on LCD 22 based on the retrieved zoom rate M, so that movement T takes a constant value.

When movement amount T is determined by movement amount modifier 77, display controller 75 generates a simulated image of the relocated embroidery pattern image 25 (S104). This means that, display controller 75 generates relocated embroidery pattern image 25 reflecting movement amount T specified/modified by movement amount modifier 77 based on the number of operations of transfer key 35. Then, display controller 75 updates the output of LCD 22 and displays the relocated embroidery pattern image 25 on LCD 22 (S105). As described above, LCD 22 displays the relocated embroidery pattern image 25 based on the specified/modified movement amount T.

Controller 50, when completing the series of processes up to step S105, returns the process flow to step S101 and repeats step S101 onwards.

Sewing machine 10 according to the first exemplary embodiment set forth above provides the following advantages.

Movement amount modifier 77, when receiving inputs from transfer key 35, specifies/modifies movement amount T of embroidery pattern image 25 displayed on LCD 22 depending on zoom rate 14 specified by zoom rate specifier 76. Then, display controller 75 transfers embroidery pattern image 25 displayed on LCD 22 based on the movement amount determined by movement amount modifier 77. Thus, as the result of such determination of movement amount, embroidery pattern image 25 displayed on LCD 22 relatively increase/decrease its movement amount T responsive to inputs made through transfer key 35 in consideration of zoom rate M in which it is being displayed so that the movement T so as to allow the location of the embroidery pattern to be sewn to be precisely yet readily determined by referring to LCD 22.

Further, movement amount modifier 77 maintains movement amount T of embroidery pattern image 25 displayed on LCD 22 at a constant value so that it appears to be not correlated with zoom rate M of embroidery pattern image 25. Thus, movement amount T of embroidery pattern image 25 in response to a single operation of transfer key 35 becomes relatively smaller as zoom rate 14 of embroidery pattern image 25 displayed on LCD 22 becomes greater. This facilitates subtle adjustment in the location of the embroidery pattern. By contrast, movement amount T of embroidery pattern image 25 in response to a single operation of transfer key 35 becomes relatively greater as zoom rate M of embroidery pattern image 25 displayed on LCD 22 becomes smaller. Thus, subtle adjustments in the location of the embroidery pattern become easier to allow the location of the embroidery pattern to be sewn to be precisely yet readily determined.

Next, a description will be given on a second exemplary embodiment of the present disclosure. Portions that are identical to those of the first exemplary embodiment such as the overall configuration of sewing machine 10 will not be re-described.

Figure 7:
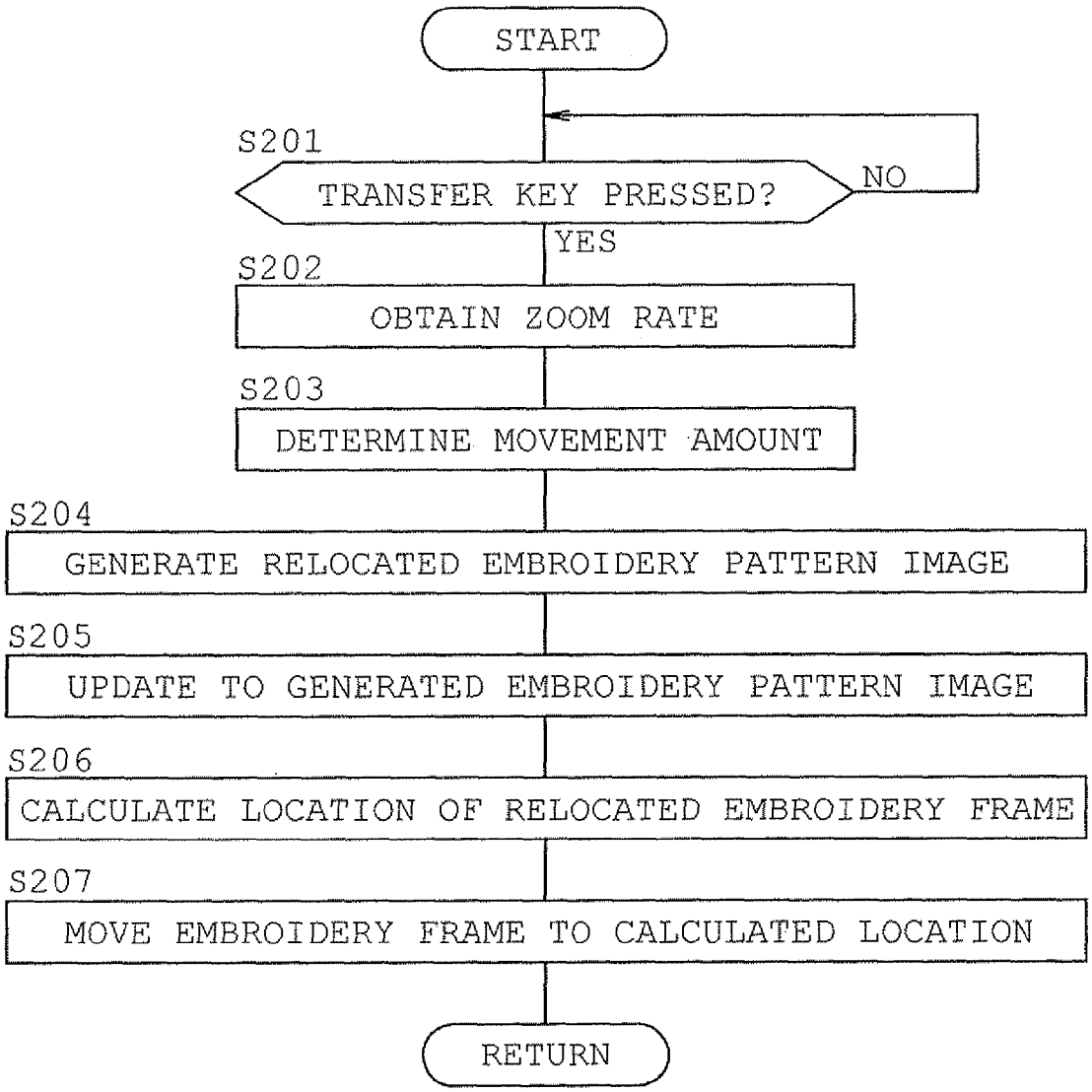
FIG. 7 is a flowchart indicating the process flow executed by the sewing machine according to a second exemplary embodiment of the present disclosure.

According to the second exemplary embodiment, movement of embroidery pattern image 25 on LCD 22 causes movement of embroidery frame 41 driven by embroidery frame transfer mechanism 40. Next, the working of sewing machine 10 will be described with reference to FIG. 7. The processes that are identical to steps S101 to S105 of the first exemplary embodiment will not be re-described.

Controller 50 monitors the presence/absence of the depression of transfer key 35 (step: S201). Controller 50, when determining that transfer key 35 has not been depressed (S201: No), stands by until transfer key 35 is depressed. When controller 50 determines that any one of direction keys 351 to 358 of transfer key 35 has been depressed (S201: Yes), retrieves zoom rate M of embroidery pattern image 25 currently being displayed on LCD 22 (S202) from zoom specifier 76.

Controller 50, upon retrieving zoom rate M, specifies movement amount T and movement amount TB of embroidery frame 41 based on the retrieved zoom rate M by way of movement amount modifier 77 (S203). To elaborate, based on zoom rate M of embroidery pattern image 25, movement amount modifier 77 determines movement amount T of embroidery pattern image 25 displayed on LCD 22 as well as movement amount TB of embroidery frame 41 driven by embroidery frame transfer mechanism 40 which are effected by a single depression of transfer key 35. More specifically, movement amount modifier 77 specifies/modifies the movement amount effected by a single depression of transfer key 35 such that movement amount T, typically represented in number of dots, of embroidery pattern image 25 within image display area 23 of LCD 22 as well as movement amount TB, typically described in millimeters (mm), of the embroidery pattern to be formed on workpiece cloth 17 held by embroidery frame 41 are constant irrespective of zoom rate H of embroidery pattern image 25 displayed on LCD 22.

For instance, supposing that when zoom rate M=100%, embroidery pattern image 25 displayed on LCD 22 is moved by 10 dots by a single depression of transfer key 35 and embroidery frame 41 driven by embroidery frame drive mechanism 40 is transferred by 10 mm by a single depression of transfer key 35. Under the conventional configuration, movement amount T and movement amount TB are determined so as to be proportional to zoom rate M, and thus, when zoom rate M=200%, embroidery pattern image 25 displayed on LCD 22 is moved by 20 dots and embroidery frame 41 driven by embroidery frame drive mechanism 40 is transferred by 20 mm. Similarly, when zoom rate M=300%, embroidery pattern image 25 displayed on LCD 22 is moved by 30 dots and embroidery frame 41 driven by embroidery frame drive mechanism 40 is transferred by 30 mm. By contrast, when zoom rate M=50%, embroidery pattern image 25 displayed on LCD 22 is moved by 5 dots by a single depression of transfer key 35 and embroidery frame 41 is transferred by 5 mm. As can be seen through the above given examples, movement amount T of embroidery pattern image 25 and movement amount TB of embroidery frame 41 driven by embroidery frame transfer mechanism 40 effected by a single depression of transfer key 35 actually (not seemingly) increase/decrease with zoom rate M, in this case, in proportional correlation with zoom rate M. This means that, movement amount TB of embroidery frame 41 driven by embroidery frame transfer mechanism 40 effected by a single operation of transfer key 35 actually increases as zoom rate M of embroidery pattern image 25 displayed on LCD 22 increases to undesirably result in the actual increase in the amount of movement of the embroidery pattern to be sewn.

Movement amount modifier 77 determines movement amount T of embroidery pattern image 25 displayed on LCD 22 and movement amount TB of embroidery frame 41 driven by embroidery frame transfer mechanism 40 in consideration of zoom rate M of embroidery pattern image 25. In the second exemplary embodiment, movement amount modifier 77 specifies movement amount T of embroidery pattern image 25 displayed on LCD 22 and movement amount TB of embroidery frame 41 driven by embroidery frame transfer mechanism 40 at a constant value so as not to be associated with the increase/decrease in zoom rate M embroidery pattern image 25.

For instance, supposing that when zoom rate M=100%, embroidery pattern image 25 displayed on LCD 22 is moved by 10 dots by a single depression of transfer key 35 and embroidery frame 41 driven by embroidery frame transfer mechanism 40 is transferred by 10 mm. According to the second exemplary embodiment, even if zoom rate M is varied to M=200% and M=300%, movement amount T of embroidery pattern image 25 displayed on LCD 22 is specified at 10 dots and embroidery frame 41 driven by embroidery frame transfer mechanism 40 is specified at 10 mm by a single operation of transfer key 35. Thus, movement amount T of embroidery pattern image 25 displayed on LCD 22 stays constant at 10 dots and embroidery frame 41 driven by embroidery frame transfer mechanism 40 stays constant at 10 mm by a single operation of transfer key 35 regardless of increase/decrease in zoom rate M. According to such configuration, when movement amount T of embroidery pattern image 25 and movement amount TB of embroidery frame 41 at zoom rate M=100% are represented as X, movement amount T of embroidery pattern image 25 and movement amount TB of embroidery frame 41 viewed at zoom rate M=200% can be represented as ½X. This means that, movement of 10 dots of embroidery pattern image 25 or movement of 10 mm of embroidery frame 41 driven by embroidery frame transfer mechanism 40 when zoom rate M=200% corresponds to movement of 5 dots or movement of 5 mm of embroidery frame 41 at zoom rate M=100%. Similarly, when zoom rate M=300%, movement amount T of embroidery pattern image 25 and movement amount TB of embroidery frame 41 by comparison to 100% zoom rate can be represented as ⅓X. When, zoom rate M=50%, the actual movement amount T of embroidery pattern image 25 represented on LCD 22 stays at 10 dots and the actual movement amount TB of embroidery frame 41 driven by embroidery frame transfer mechanism 40 stays at 10 mm. Thus, movement amounts of embroidery pattern image 25 displayed at zoom rate M=50% and the corresponding movement amount of embroidery frame 41 appears to be 2× or twice of the movement amount of zoom rate M=100%.

As described above, movement amount modifier 77 specifies/modifies movement amount T of embroidery pattern image 25 displayed on LCD 22 and movement amount TB of embroidery frame driven by embroidery frame transfer mechanism 40 in consideration of the obtained zoom rate M so that movement amount T and movement amount TB take constant values.

When movement amount modifier 77 determines movement amount T of embroidery pattern image 25 and movement amount TB of embroidery frame 41, display controller 75 generates a relocated image of embroidery pattern image 25 (S204). More specifically, based on the number of operations on transfer key 35, display controller 75 generates a relocated embroidery pattern image 25 depending on the movement amount specified/modified by movement amount modifier 77. Then, display controller 75 updates the output of LCD 22 and displays the generated relocated embroidery pattern image 25 on LCD 22 (S205). Further, controller 50 calculates the relocated position of embroidery frame 41 based on movement amount TB embroidery frame 41 determined at S203 (S206). That is, based on the number of operations of transfer key 35, controller 50 calculates the relocated location of embroidery frame 41 corresponding to movement amount TB specified/modified at movement amount modifier 77. Then, controller 50 drives X-shaft motor 65 and Y-shaft motor 66 to transfer embroidery frame 41 to the relocated location (S207).

Controller 50, when completing the series of processes up to S207, returns the process flow to step S201 and repeats step S201 onwards.

Sewing machine 10 according to the above described second exemplary embodiment provides the following advantages in addition to those of the first exemplary embodiment.

Controller 50 transfers embroidery frame 41 based on the inputs made through transfer key 35. Thus, amount of movement TB of embroidery frame 41 responsive to inputs made through transfer key 35, in other words, the amount of movement in the sewing position of the embroidery pattern to be sewn is relatively increased/decreased based on zoom rate M of embroidery pattern image 25 shown on LCD 22 by specifying constant movement amount T and TB. Such arrangement precisely yet readily determines the location of the embroidery pattern to be sewn.

Figure 8:
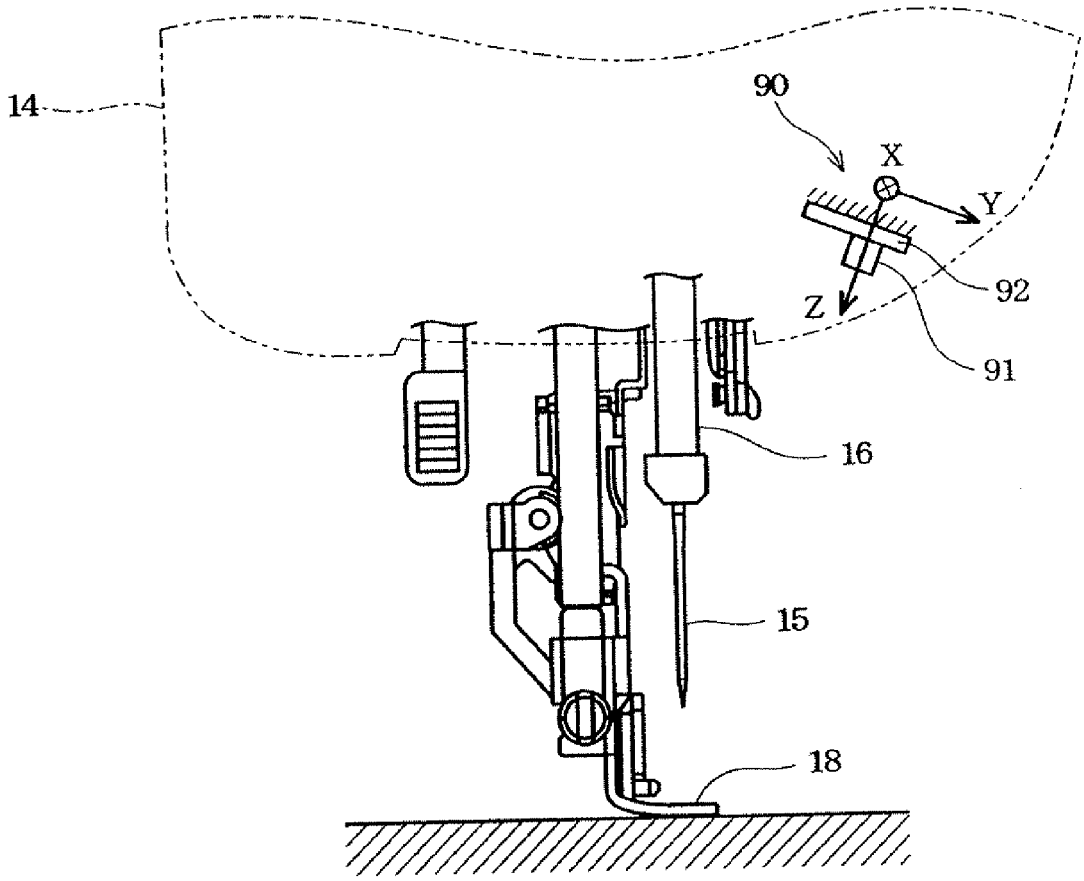
FIG. 8 illustrates important features of a sewing machine according to a third exemplary embodiment of the present disclosure.

FIG. 8 illustrates the main portions of a sewing machine according to a third exemplary embodiment.

Figure 9:
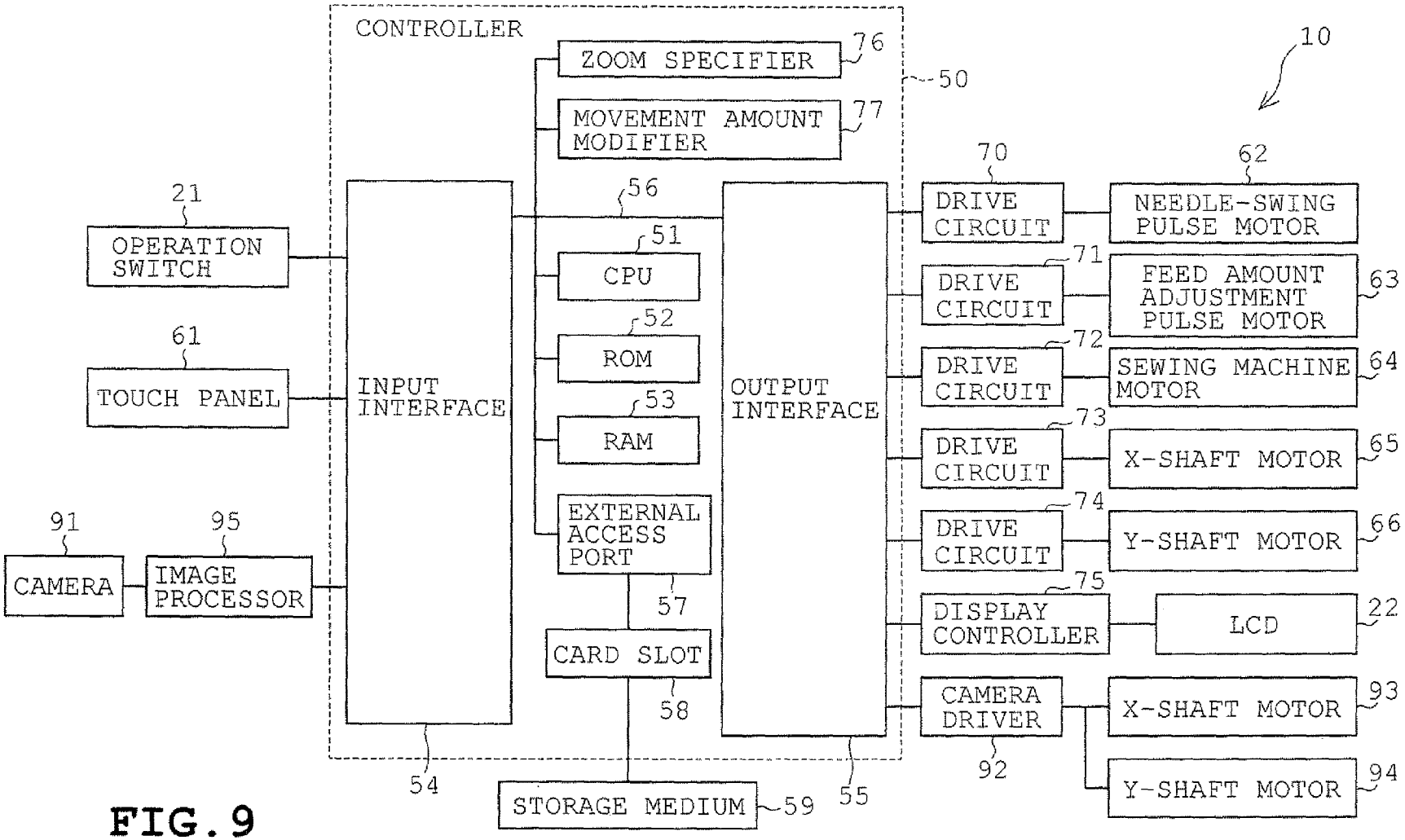
FIG. 9 illustrates an electric configuration of the sewing machine according to the third exemplary embodiment of the present disclosure and corresponds to FIG. 4.

Sewing machine 10 according to the third exemplary embodiment is further provided with image capturer 90. Image capturer 90 captures images of workpiece cloth 17 held by embroidery frame 41 especially the portions where stitches are to be formed. More specifically image capturer 90 captures images of the periphery of the needle drop point of sewing needle 15. Image capturer 90 comprises camera 91 and camera driver 92. Camera 91 comprises imaging elements such as CCD (Charge Coupled Device) and captures images of workpiece cloth 17 where the stitches are formed and its peripheral portions. Camera driver 92 is provided with X-shaft motor 93 and Y—shaft motor 94 as illustrated in FIG. 9 and is driven in the X-direction which is left and right direction and the Y-direction which is the front and rear direction relative to needle drop point. Camera 91, driven by camera driver 92, captures images of a given area surrounding the needle drop point. Sewing machine 10 is further provided with an image processor 95 that processes the image captured by camera 91 and takes in the processed image through input interface 54, which is thereafter outputted in the form of digital electric signals.

In response to the operation of transfer key 35, camera driver 92 transfers camera 91 in the X and Y directions.

Figure 10:
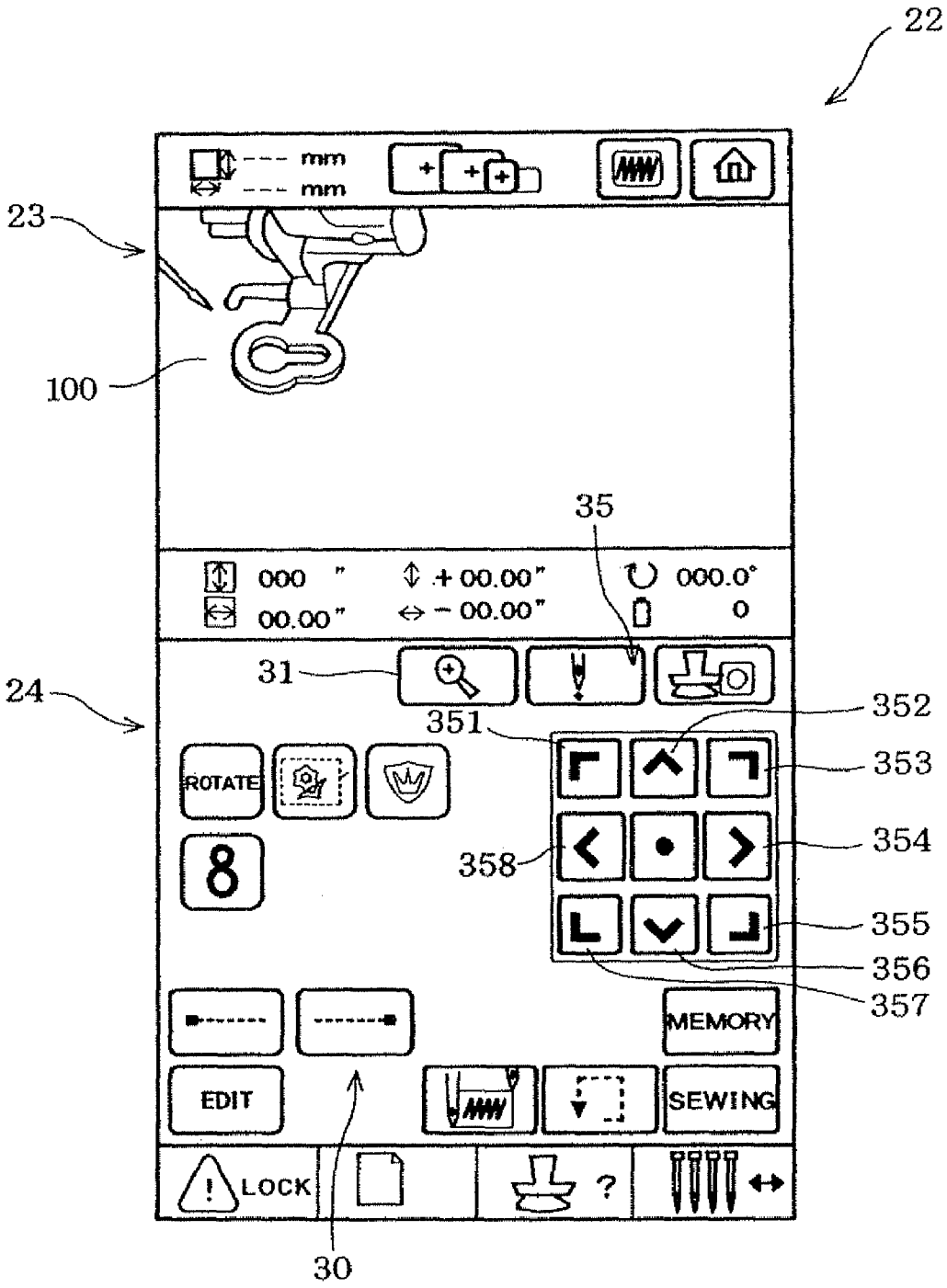
FIG. 10 illustrates an exemplary output of liquid crystal display showing a display image according to a third exemplary embodiment of the present disclosure.
Figure 11:
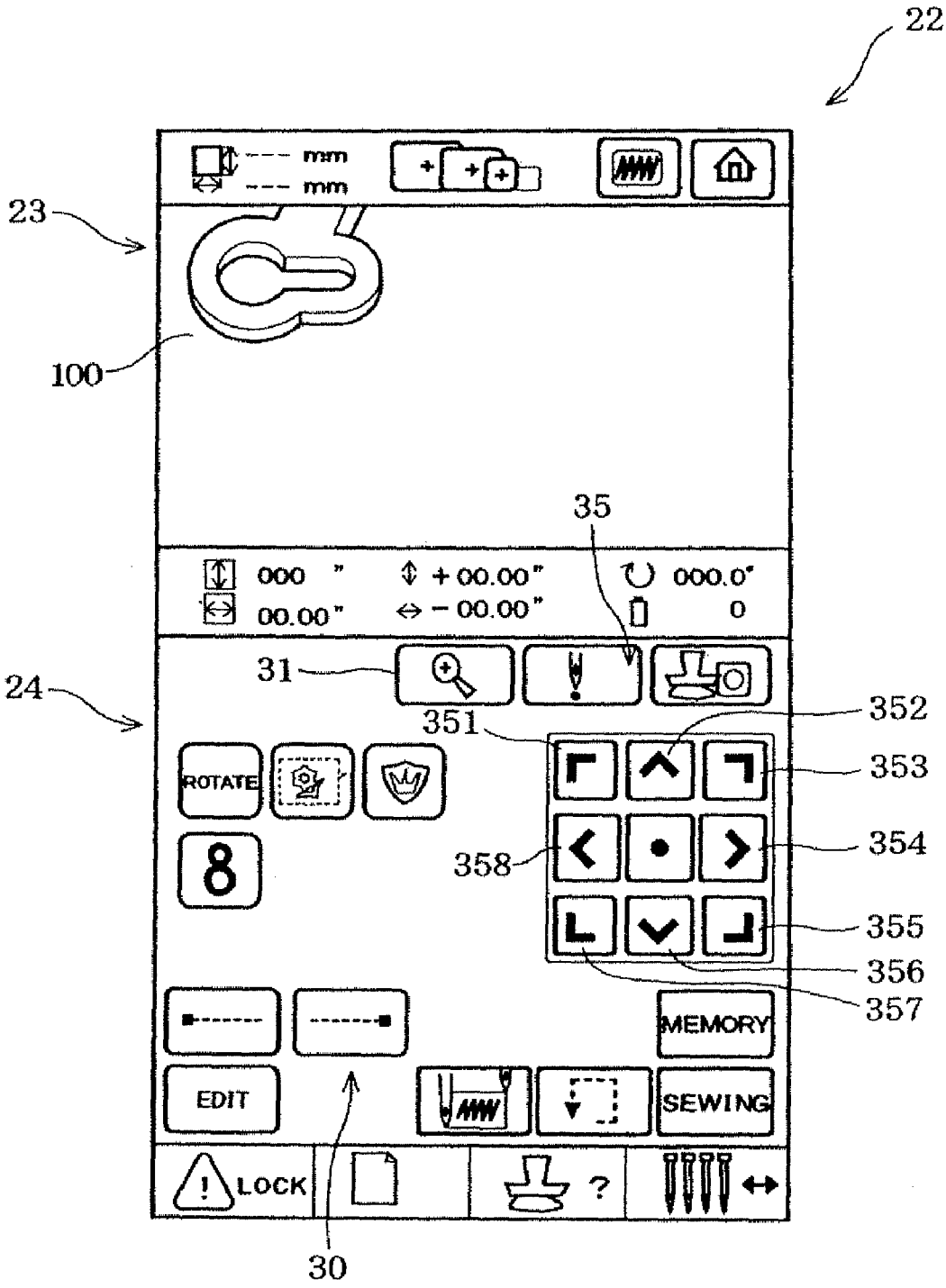
FIG. 11 illustrates an exemplary output of liquid crystal display showing an enlarged embroidery pattern image according to the third exemplary embodiment of the present disclosure.

Based on the electric signals outputted from image processor 95 of image capturer 90, display controller 75 shows the processed images of sewing portion and its periphery on LCD 22. That is, as shown in FIGS. 10 and 11, LCD 22 shows the images captured by image capturer 90 on its image display area 23 as display image 100. In addition to showing display image 100 corresponding to the capture range of image capturer 90, LCD 22 is capable of showing enlarged or shrunk images of any given image captured within the capture range as schematically illustrated in FIG. 11.

Figure 12:
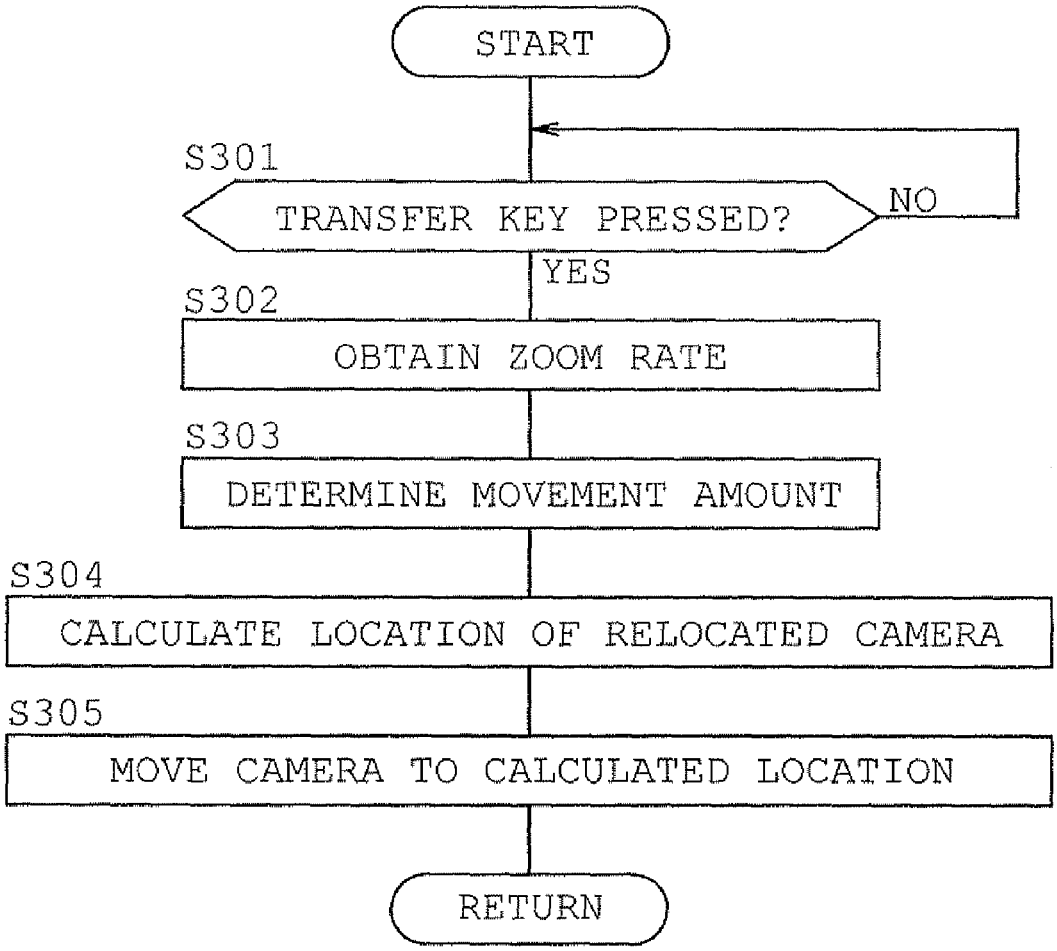
FIG. 12 is a flowchart indicating the process flow executed by the sewing machine according to a third exemplary embodiment of the present disclosure.

According to the third exemplary embodiment, camera 91 is moved in response to the operation of transfer key 35 by way of camera driver 92. The movement of camera 91 results in movement of the capture range of camera 91, which in turn moves the range of display image 100 of LCD 22. The working of sewing machine 10 according to the third exemplary embodiment will be described with reference to FIG. 12. The processes that are identical to steps S101 to S105 of the first exemplary embodiment will not be re-described in detail.

Controller 50 monitors the presence/absence of the depression of transfer key 35 (step: S301). Controller 50, when determining that transfer key 35 has not been depressed (S301: No), stands by until transfer key 35 is depressed. When controller 50 determines that any one of direction keys 351 to 358 of transfer key 35 has been depressed (S301: Yes), retrieves zoom rate M of display image 100 currently being displayed on LCD 22 (S302) from zoom specifier 76.

Controller 50, upon retrieving zoom rate M, determines movement amount TC of camera 91 based on the retrieved zoom rate M by way of movement amount modifier 77 (S303). To elaborate, movement amount modifier 77 determines movement amount TC of capture range of display image 100 displayed on LCD 22, in other words, movement amount TC of camera 91 driven by camera driver 92 which is effected by a single depression of transfer key 35 based on zoom rate M of acquired display image 100. More specifically, movement amount modifier 77 specifies/modifies movement amount TC of camera 91, typically represented millimeters (mm), effected by a single depression of transfer key 35 such that movement amount, also typically represented in millimeters (mm) is constant so as not to increase/decrease with zoom rate M.

For instance, supposing that when zoom rate M=100%, capture range of display image 100 displayed on LCD 22 is moved by 10 mm by a single depression of transfer key 35. Under the conventional configuration, movement amount TC of capture range and camera 91 are determined in proportion to zoom rate M, and thus, when zoom rate M=200%, camera 91 is driven by camera driver 92 so as to be transferred by 20 mm by a single operation of transfer key 35. Accordingly, display image 100 displayed on LCD 22 is transferred by 20 mm. Similarly, when zoom rate M=300%, display image 100 or the capture range is transferred by 30 mm. By contrast, when zoom rate M=50%, display image 100 is transferred by 5 mm by a single depression of transfer key 35. As can be seen through the above given examples, the movement amount of the capture range of display image 100 effected by a single depression of transfer key 35 actually increases/decreases with zoom rate M, in this case in proportional correlation, according to the conventional configuration. This means that, movement amount TC of camera 91 effected by a single operation of transfer key 35 increases as zoom rate M of display image 100 displayed on LCD 22 increases to result in an increased movement in the capture range of camera 91.

In the third exemplary embodiment, movement amount modifier 77 specifies/modifies the movement amount of display image 100 displayed on LCD, in other words, movement amount TC of camera 91 driven by camera driver 92. More specifically, movement amount modifier 77 specifies movement amount TC of camera 91 driven by camera driver 92 at a constant value so as not increase/decrease with zoom rate M.

For instance, supposing that when zoom rate M=1004, camera 92 is transferred by 10 mm by a single depression of transfer key 35 to cause the capture range of display image 100 to be transferred by 10 mm. According to the third exemplary embodiment, even if zoom rate M is varied to M=200% and M=300%, movement amount modifier 77 specifies/modifies movement amount TC of camera 91, that is, the movement amount of capture range of display image 100 effected by a single operation of transfer key 35 to 10 mm. As a result of such specification, movement amount TC of camera 91 driven by camera driver 92 stays constant at 10 mm while the amount of movement of capture range of display image 100 displayed on LCD 22 also stays constant at 10 mm so as not to increase with zoom rate M. According to such configuration, when the movement amount TC of camera 91 driven by camera driver 92 when zoom rate M=100% is represented as X, movement amount TC at zoom rate M=200% can be represented as ½X. This means that, movement of 10 mm of camera 91 at zoom rate 200% corresponds to movement of 5 mm of camera 91 at zoom rate M=1.00%. Similarly, when zoom rate M=300%, the movement amount TC of camera 91 can be represented as ⅓X. When, zoom rate M=50%, movement amount TC of camera 91 driven by camera driver 92 in response to a single operation of transfer key 35 is specified at 10 mm. Thus, when zoom rate M=50%, movement amount TC effected by a single operation of transfer key 35 can be represented as 2× or meaning that it appears to be double of the amount of movement by comparison to zoom rate M=100%.

As described above, movement amount modifier 77 specifies/modifies movement amount TC of camera 91 in consideration of the obtained zoom rate M such that movement amount TC of camera 91 driven by camera driver 92, that is, the movement amount of capture range of display image 100 displayed on LCD 22 takes a constant value of, for instance, 10 mm.

When movement amount modifier 77 has specified, in other words, has determined movement amount TC of camera 91, camera driver 92 calculates relocated location of camera 91 based on the specified movement amount TC (S304). That is, camera driver 92 calculates relocated location of camera 91 corresponding to specified movement amount TC specified by movement amount modifier 7 based on the number of operations made through transfer key 35. Then, camera driver 92 drives X-shaft motor 93 and Y-shaft motor 94 to transfer camera 91 to the relocated location (S305).

Controller 50, when completing the series of processes up to S305, returns the process flow to step S301 and repeats step S301 onwards.

Sewing machine 10 according to the above described third exemplary embodiment provides the following advantages in addition to sewing machine 10 of the first exemplary embodiment.

Camera driver 92 transfers camera 91 based on the inputs made through transfer key 35. Camera 91, being driven by camera driver 92, relatively increases or decreases the level of movement amount TC to be effected in response to the depression of transfer key 35 depending upon zoom rate M of display image 100 displayed on LCD 22. As a result, the level of movement amount of capture range of display image 100 displayed on LCD 22 to be effected in response to the depression transfer key 35 is also relatively increased or decreased in consideration of zoom rate M of display image 100. The above described configuration precisely yet readily determines the capture range encompassing the proximity of the needle drop position where stitches are formed.

The present disclosure is not limited to the foregoing exemplary embodiments but may be subjected to various modifications as long as such modifications are true to the spirit of the inventive concept.

The configuration for transferring camera 91 disclosed in the third exemplary embodiment may be applied to the transfer of embroidery frame 41 which was one example of the targets of image capturing by camera 91. In such case, movement amount modifier 77 specifies the movement amount of embroidery frame depending upon the zoom rate of display image 100 displayed on LCD 22.

Further, camera 91 disclosed in the third exemplary embodiment may be secured unmovably to sewing machine 10. In this case, camera 91 captures images within a fixed capture range. According to such configuration, image processor 95 may be configured to generate trimmed images, which have been trimmed from the images captured from the fixed capture range, that have been enlarged or shrunk based on zoom rate of display image 100 displayed on LCD 22. In such case, the movement amount of trim range may be specified depending upon the zoom rate of display image 100.

Further, movement amount modifier 77 disclosed in the foregoing exemplary embodiments have been configured to specify the level of movement amount for embroidery pattern image 25, embroidery frame 41, or camera 91 to be effected by a single depression of transfer key 35. However, movement amount modifier 77 may be further configured to specify the movement amount in response to a prolonged depression of transfer key 35. Further, movement mount modifier 77 may be configured to specify the movement speed of embroidery pattern image 25, embroidery frame 41, or camera 91 in response to the depression of transfer key 35 instead of specifying the movement amount.

Further, transfer key 35 provided on touch panel 61 of LCD 22 in the foregoing exemplary embodiments may be replaced by pointing devices such as a mouse.

The first exemplary embodiment set forth above disclosed specifying the movement amount T of embroidery pattern image 25 displayed on LCD 22 at 10 dots even when zoom rate M of embroidery pattern image 25 has doubled such that movement amount T of embroidery pattern image 25 appear to be ½ of that of zoom rate M=100%. However, zoom rate M and movement amount T need not be limited to an inverse proportional relation but may be specified to establish other relations. The same is applicable to the second and the third exemplary embodiments as well as when displaying shrunk embroidery pattern image 25 on LCD 22.

While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. An embroiderable sewing machine, comprising:

an embroidery frame that is configured to hold a workpiece cloth;

an embroidery frame transfer mechanism that is configured to horizontally transfer the embroidery frame;

a display device that is capable of displaying an image of an embroidery pattern to be sewn on the workpiece cloth as an embroidery pattern image;

a zoom rate specifier that is configured to specify a zoom rate for enlarging or shrinking the embroidery pattern image displayed on the display device;

an input section that is configured to receive inputs of instructions for moving a location of the embroidery pattern to be sewn within an embroiderable area defined by the embroidery frame, the instructions including a movement direction and a movement amount;

a movement amount modifier that is configured to modify the movement amount inputted by the input section for the embroidery pattern image displayed on the display device based on the zoom rate specified by the zoom rate specifier;

a display controller that is configured to transfer the embroidery pattern image displayed on the display device based on the movement amount modified by the movement amount modifier in response to the input from the input section, and a drive controller that is configured to control driving of the embroidery frame transfer mechanism, the drive controller transferring the embroidery frame based on the movement amount modified by the movement amount modifier in response to the input from the input section;

wherein the movement amount modifier modifies the movement amount of the embroidery pattern image displayed on the display device and the movement amount of the embroidery frame transferred by the drive controller so that the movement amounts appear to be relatively smaller as the zoom rate increases.

2. The embroiderable sewing machine according to claim 1, further comprising an image capturing device that is configured to capture images of the workpiece cloth held by the embroidery frame so that the captured images show portions of the workpiece cloth where stitches are formed and peripheral portions thereof, wherein the display device is configured to display a display image generated based on the image captured by the image capturing device.

3. The embroiderable sewing machine comprising:

an embroidery frame that is configured to hold a workpiece cloth;

an embroidery frame transfer mechanism that is configured to horizontally transfer the embroidery frame;

an image capturing device that is configured to capture images of the workpiece cloth held by the embroidery frame so that the captured images show portions of the workpiece cloth where stitches are formed and peripheral portions thereof;

a display device that is capable of displaying a display image generated based on the image captured by the image capturing device;

a zoom rate specifier that is configured to specify a zoom rate for enlarging or shrinking the embroidery pattern image displayed on the display device;

an input section that is configured to receive inputs of instructions for moving a location of the embroidery frame, the instructions including a movement direction;

a movement amount modifier that is configured to modify the movement amount of the embroidery frame transferred by the embroidery frame transfer mechanism based on the zoom rate specified by the zoom rate specifier; and a controller that is configured to control the embroidery frame transfer mechanism so that the embroidery frame is transferred based on the movement amount modified by the movement amount modifier in response to the input from the input section.

4. The embroiderable sewing machine according to claim 3, wherein the movement amount modifier modifies the movement amount of the embroidery frame so that the movement amount appears to be relatively smaller as the zoom rate increases.

* * * * *